US011530066B2

(12) United States Patent
Sturgeon

(10) Patent No.: US 11,530,066 B2
(45) Date of Patent: Dec. 20, 2022

(54) NESTABLE AND STACKABLE WIDE-BASED DISPOSABLE CONTAINER

(71) Applicant: Xiaolu Huang Sturgeon, Thornton, CO (US)

(72) Inventor: Xiaolu Huang Sturgeon, Thornton, CO (US)

(73) Assignee: Xiaolu Huang Sturgeon, Thornton, CO (US)

( * ) Notice: Subject to any disclaimer, the term of this patent is extended or adjusted under 35 U.S.C. 154(b) by 0 days.

(21) Appl. No.: 15/929,157

(22) Filed: Nov. 5, 2019

(65) Prior Publication Data

US 2020/0156815 A1 May 21, 2020

Related U.S. Application Data

(60) Provisional application No. 62/768,109, filed on Nov. 16, 2018.

(51) Int. Cl.

| | |
|---|---|
| ***B65B 67/12*** | (2006.01) |
| ***B65F 1/00*** | (2006.01) |
| ***B65D 21/02*** | (2006.01) |

(52) U.S. Cl.

CPC ..... *B65B 67/1238* (2013.01); *B65D 21/0233* (2013.01); *B65F 1/0006* (2013.01)

(58) Field of Classification Search

CPC ..... B65D 67/1238; B65D 21/0233; B65F 1/0006

USPC ..... 220/495.06, 908, 910, 911, 495.07, 220/495.09; 383/32, 33, 36, 34, 34.1

See application file for complete search history.

(56) References Cited

U.S. PATENT DOCUMENTS

| | | | | | |
|---|---|---|---|---|---|
| 1,238,090 | A | * | 8/1917 | Beringer | B65F 1/10 220/254.2 |
| 3,533,807 | A | * | 10/1970 | Wakefield | B65D 85/816 426/112 |
| 3,806,984 | A | * | 4/1974 | Hilsabeck | E01H 1/1206 294/1.3 |
| 3,944,110 | A | | 3/1976 | Willis | |
| 4,014,157 | A | * | 3/1977 | Pearce | B65B 67/1238 53/459 |
| 4,166,572 | A | | 9/1979 | Leeds | |
| 4,437,575 | A | | 3/1984 | Hahn | |
| 4,610,039 | A | * | 9/1986 | Stern | A61J 19/00 4/285 |

(Continued)

FOREIGN PATENT DOCUMENTS

| | | | |
|---|---|---|---|
| CH | 675351 | A5 | 9/1990 |
| FR | 2724551 | A1 | 3/1996 |
| WO | 2006078448 | A2 | 7/2006 |

*Primary Examiner* — J. Gregory Pickett
*Assistant Examiner* — Niki M Eloshway

(57) ABSTRACT

One example of a nestable-stackable wider-based disposable container is composed of a plastic-coated paper frustoconical tube having its wider end edge connected continuously to the mouth of a plastic bag whose capacity is larger than the tube size. For storage, let the wide end of one container to receive the narrow end of another container. The plastic bag of the former is forced to push up inwardly and to cleave tightly to the paper side wall, allowing the later to be compactly nested into the former. For usage, one stands a container on its non-tipping wider end, places items in via its upper narrower opening, discards it as a whole unit when done. Other examples are described and shown.

2 Claims, 10 Drawing Sheets

(56) References Cited

U.S. PATENT DOCUMENTS

| | | | | |
|---|---|---|---|---|
| 4,948,266 | A | 8/1990 | Bencic | |
| 5,000,334 | A | 3/1991 | Miller et al. | |
| 5,036,998 | A | 8/1991 | Dunn | |
| 5,628,396 | A | 5/1997 | Weiner | |
| 5,839,590 | A | 11/1998 | Weiner | |
| 6,164,821 | A * | 12/2000 | Randall | B65D 33/1658 150/120 |
| 2005/0281488 | A1* | 12/2005 | Cawley | B65D 33/007 383/33 |
| 2007/0031068 | A1* | 2/2007 | Gillis | A61J 19/00 383/33 |
| 2008/0131034 | A1* | 6/2008 | Sulpizio | B65D 33/007 383/119 |
| 2008/0247679 | A1* | 10/2008 | Dayton | B65D 33/25 383/33 |
| 2009/0097780 | A1* | 4/2009 | Chapman | B65F 1/1415 383/33 |
| 2010/0278461 | A1* | 11/2010 | Veiseh | B65D 81/03 383/107 |
| 2016/0145041 | A1* | 5/2016 | Fritch | B65F 1/10 220/86.1 |

* cited by examiner

NESTABLE AND STACKABLE WIDE-BASED DISPOSABLE CONTAINER

SUMMARY

The container provides a much-needed improvement in saving stacking space for a batch of disposable non-tipping containers. It provides a wide, non-tipping base for each disposable container to stand upon. It also provides a bottom that has a flexible center and is forgiving towards the surface that it stands upon, further strengthens its non-tipping property. It allows the disposable container to provide significantly more holding capacity than its relative occupied space. Most importantly, it allows nestable stacking of wider-base disposable containers, thus saving space and strengthening the robustness of shape sustaining for a batch of disposable containers during package wrapping and handling. The disposable container can be used for waste collection or for storage of useful items.

The basic form of disposable container is composed of two main portions: a flared rigid portion that is hollow inside with two openings and a flexible portion with one opening. The wider opening rim of the flared rigid portion is joined continuously to the opening of the flexible portion. The flexible portion could be tucked into the rigid portion, be pushed inward the rigid portion while cleaving to the wall of the rigid portion, and be extended outward and downward.

In accordance with one example a disposable container is composed of a rigid portion made of flared frustoconical paper tube with its wide end opening attached continuously to the mouth of a flexible portion made of a plastic bag.

Starting with a nested and stacked batch of disposable containers, the user can take one as a waste container in a car, at pillowside on a bed, at bedside, at a restroom, at an examining room of a clinic, at an indoor banquet, at an outdoor picnic or at any other occasions. During allergy season, one can put one container next to one's car seat or at pillowside on bed and drop used tissue paper into this wide-based non-tipping disposable container and when it is filled, one can simply lift up the paper part by the upper rim and let the objects drop to the plastic bag attached below and then continue to drop the objects. After that, when it is filled, one can simply toss the whole container into a larger trash can.

One advantage of the container is that it provides a wide, non-tipping base for the disposable containers to stand upon while allowing the container to be nestable and stackable, thus saving occupied space of a batch of the disposable containers. Another advantage of the container is that a batch of nested and stacked disposable containers can be robust enough to sustain shapes during package wrapping and handling. Saying this in a different way, the containers can be shipped in stacks and this minimizes damage or deformation of the containers during shipping and transportation.

Another advantage of the container is that it not only stands on its wide end which makes it non-tipping, but also has a bottom centered with a soft and flexible material (plastic bag in the example) which allows it to be more forgiving towards the surface condition upon which it stands, further strengthening the non-tipping property of the container.

Another advantage of the container is that it includes an expandable plastic bag of high-holding-capacity which allows it to provide significantly more holding capacity than the outward size of the container.

Another advantage of the container is that it is composed of two types of low-cost disposable material.

Another advantage of the container is that when the container is filled, the whole container can just be tossed away without any cleaning hassle.

Another advantage of the container is that when the wide rigid portion is connected to the mouth of the flexible portion and the items are to be dropped through the narrow opening of the rigid part, the rigid part and the flexible part form a continuous holding space. When the rigid part also contributes to the holding capacity, it saves material, allows more compact nesting, and allows the container to stand in a more sturdy way during usage and increases the holding capacity of the container.

Other advantages of one or more aspects will be apparent from a consideration of the drawings and ensuing description.

DESCRIPTION OF THE DRAWING

The container will be described with respect to a drawing in several figures.

FIG. 8 is a perspective view of a container of FIG. 2 in use, standing upon its wide base with the plastic film partly tucked in.

FIG. 12 is a perspective view of a container of FIG. 2 in the state of FIG. 10 that is on the verge of being disposed of.

DETAILED DESCRIPTION

Figure 1:
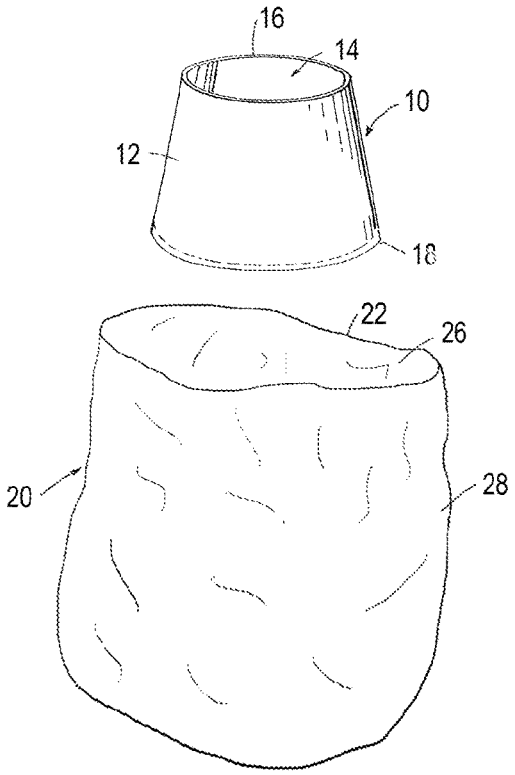
FIG. 1 is an exploded view of an example of a nestable and stackable wide-based disposable container containing a paper tube part and a plastic bag part, prior to joining of the bag to the tube.
Figure 2:
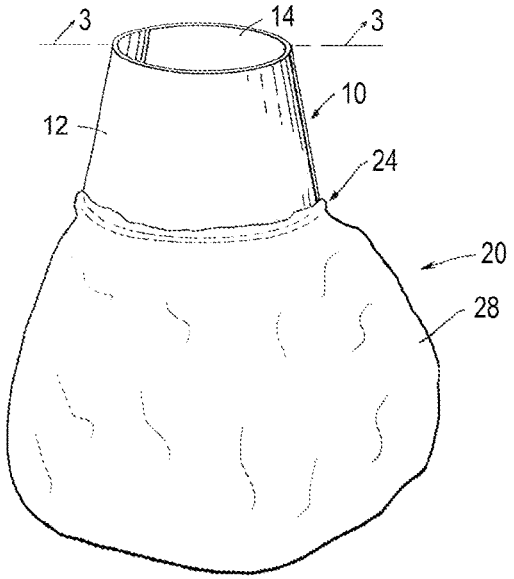
FIG. 2 is a perspective view of the assembled example nestable and stackable wide-based disposable container with the plastic film dangling out from the wide base opening of the paper frustoconical tube.

Turning first to FIG. 2, one example of the nestable and stackable wide-based non-tipping disposable container is shown. FIG. 1 is the exploded view of the nestable stackable disposable container of FIG. 2 showing that the container is comprised of two main parts: the flared downward paper part 10 and the plastic bag part 20. The paper mentioned in the above example is of a similar material to that of paper cups. As shown in FIG. 1 and FIG. 2, the paper part 10 is in a frustoconical tube shape with two openings and a hollow inside region 14. FIG. 1 shows the upper end edge rim 16 and the bottom end edge rim 18. Paper side wall 12 of paper part 10 is flared downwards forming a wider base as compared with the top opening.

It will be appreciated that the paper part 10 is rigid, and in the discussion that follows we will sometimes refer to this as "the rigid portion". It will also be appreciated that rigid paper part 10 has a capacity of at least 0.2 liters. It will be appreciated that the plastic bag part 20 is flexible, and in the discussion that follows we will sometimes refer to this as "the flexible portion".

In FIG. 1, the purpose of the upper narrow end opening is to allow object disposition, and the purpose of the lower wide end opening is for connection to plastic bag 20 by attachment of the mouth of plastic bag opening 22 onto rim 18.

Figure 3:
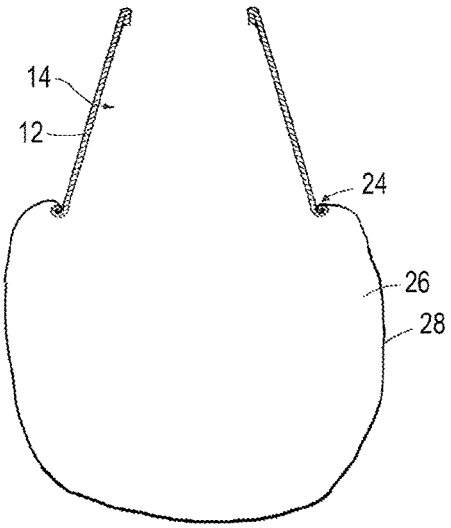
FIG. 3 is a cross-sectional view on line 3-3 of FIG. 2.

Plastic bag 20 is comprised of plastic film 28 with opening 22. FIG. 3 is a cross-sectional view of FIG. 2 and it shows connection 24 formed by joining continuously the mouth region of plastic bag 20 to base opening edge rim 18. Connection 24 of the container is formed by having the bottom opening rim curled along with the mouth region of plastic bag 20, so the mouth may be securely attached to the bottom opening 18. Another possible connection approach is that the paper part is coated with plastic to be attached to bag 20 by means of ultrasonic welding of plastic to plastic or heat welding of plastic to plastic. Still another possible approach is that the mouth of the plastic bag is glued, stapled or stitched to the rim of the rigid part. Connection 24 can be formed via any other means.

Since connection 24 is formed by joining continuously the mouth region of plastic bag 20 to the wide base opening edge rim 18 and items 5 are to be dropped through the narrow opening 16 of paper tube 10, the paper part and the plastic part form a continuous holding space. When the rigid paper part also contributes to the holding capacity, it saves material, It allows more compact nesting, it allows the container stand in a more sturdy way during usage, and it increases the holding capacity of the container.

Figure 4:
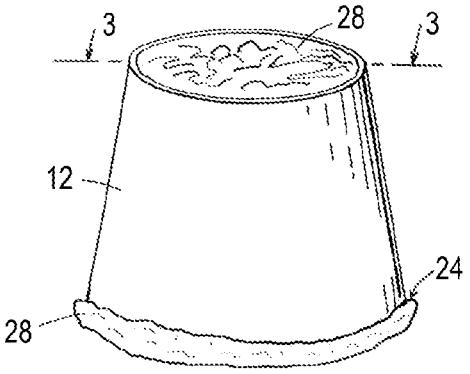
FIG. 4 is a perspective view of the container of FIG. 2 in a state of having the plastic film mostly cleaved to the inner side of the paper side wall and is shown at the upper opening of the paper.
Figure 5:
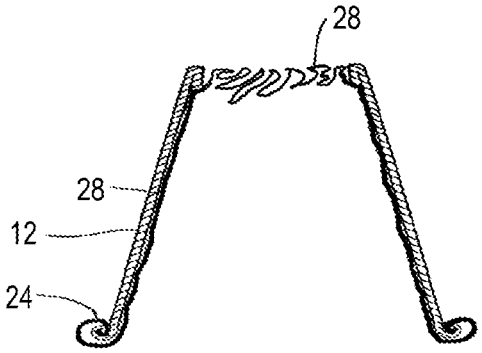
FIG. 5 is a cross-sectional view on line 3-3 of FIG. 4.

FIG. 4 is a perspective view of the nestable and stackable wide-based disposable container in the state of being nested and stacked. FIG. 4 shows that the upper opening of the paper part is blocked by plastic film 28 of plastic bag 20. FIG. 5 is the cross-sectional view of FIG. 4 showing that plastic film 28 being mostly cleaved onto the inner side of paper side wall 12 and is pushed all the way to the upper opening of the paper part. FIG. 5 shows that the container in the state of FIG. 4 has a similar form as a paper cup with its wider end ready to be nestly stacked. The alert reader will appreciate that for this to work, the flexible portion must have a capacity that is at least as great as the capacity of the rigid portion.

Figure 6:
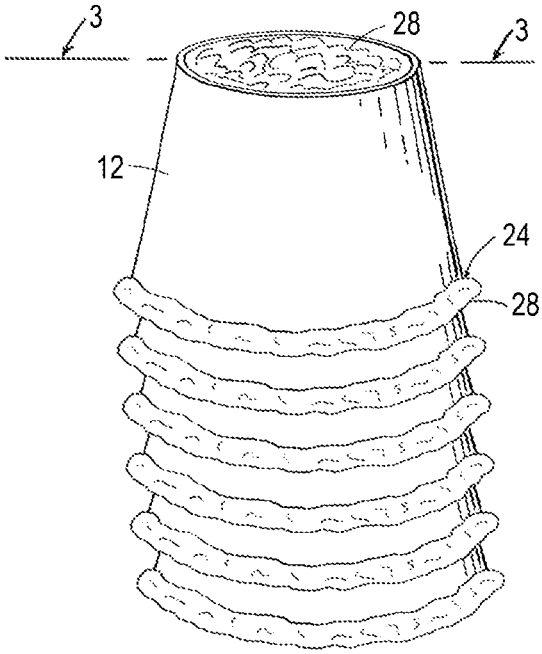
FIG. 6 is a perspective view of a batch of containers of FIG. 2 each of which is in the state shown in FIG. 5.
Figure 7:
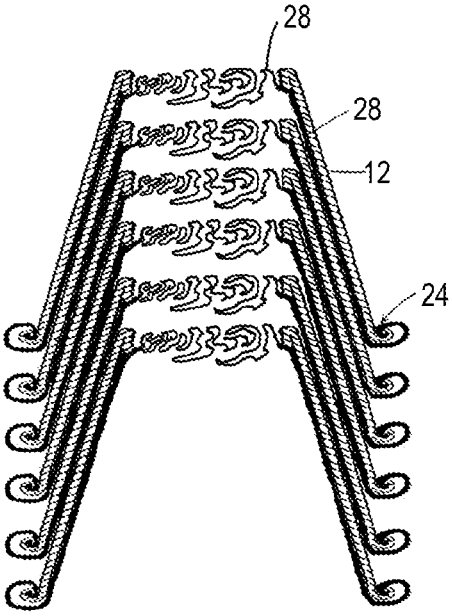
FIG. 7 is a cross-sectional view on line 3-3 of FIG. 6.

FIG. 6 shows a batch of nestly stacked wide-base disposable containers each in the state of FIG. 4. FIG. 7 is the cross-sectional view of FIG. 6. As was mentioned above, this stacking offers several benefits.

One benefit is that because the containers are stacked, this saves space. The stacked containers can be shipped from factory to store, and transported from the store to a customer, and the stacking protects the containers from damage and deformation during shipping and transportation.

Figure 8:
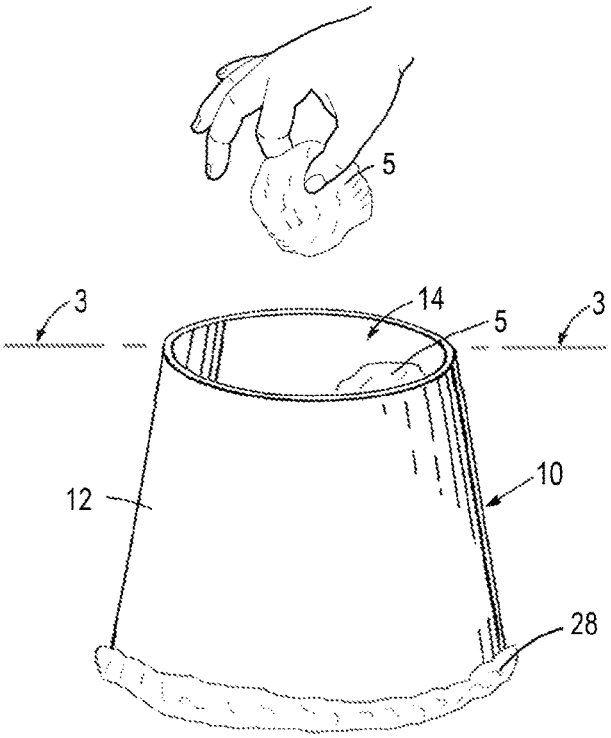
Figure 9:
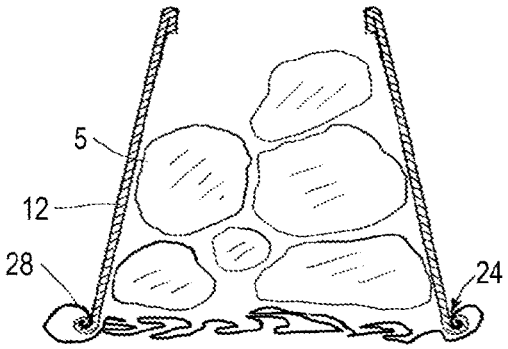
FIG. 9 is a cross-sectional view on line 3-3 of FIG. 8.

FIG. 8 is a perspective view of a nestable and stackable wide-based disposable container in use and it stands upon its wide base with the plastic film 28 tucked inside. In FIG. 8, the container is in a state with an opening at its upper narrower end and the wider base end closed by plastic bag 20. In FIG. 8, disposed objects 5 (not part of the container) are disposed inside the container through the upper narrow opening and are retained at the base of the container. FIG. 9 is a cross-sectional view of FIG. 8 showing that when the container is standing upon its base of paper part 10 as is in FIG. 8, the plastic film 28 is mostly crumpled and pleated at the bottom inside paper part 10. The alert reader will appreciate that the bottom of the container in FIG. 8 has a soft flexible center portion which is composed of plastic bag material and it allows the container to adapt better to the surface it stands upon as contrasted to those rigid bottoms of conventional disposable cups or disposable bucket.

Figure 13:
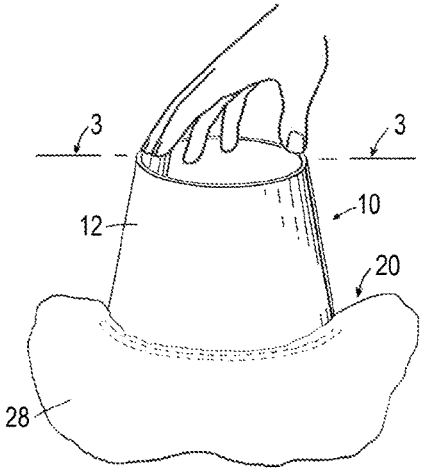
FIG. 13 is a perspective view of a container of FIG. 2 in use, standing upon a bulged-out plastic bag with some disposed items inside.
Figure 14:
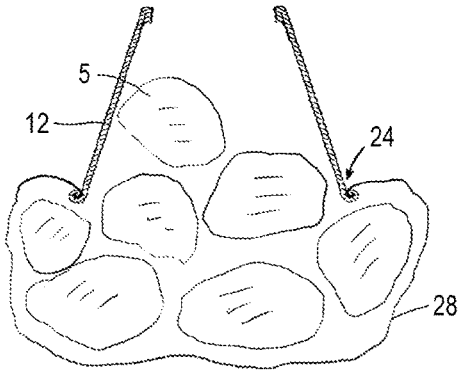
FIG. 14 is a cross-sectional view on line 3-3 of FIG. 13.

When the volume of disposed objects 5 exceeds the size of paper part 10, paper part 10 can be lifted up and this lets the disposed objects drop into the plastic bag 20, thus releasing room for holding more objects. Turning ahead to FIG. 13, FIG. 13 is a perspective view of a disposable container in use and its paper part 10 stands upon the bulged-out plastic bag 20 with disposed objects 5 inside. FIG. 14 is a cross-sectional view of FIG. 13.

These disposable containers of FIG. 2 can be of various frustoconical shapes and size: the outward shape could be like that of a paper cup or it could be like a rigid flared ring. It could be as big as or bigger than a regular sized bucket or as small as or smaller than a small size disposable cup.

Operation. To stack and to nest wide-based disposable containers, one simply need to stack the upper narrow end opening of one container into the lower wide end of another container just as how paper cups are nested and stacked. When receiving the narrow end of another container at its wide base end, the container has its plastic bag part 20 being forced to push up inwardly, causing the plastic film to cleave to the inside wall of the paper part and to reach upper narrow end opening 14, just as those shown in FIG. 6 and in FIG. 7.

Such a stack of containers is very sturdy for maintaining the shapes of the containers when being wrapped, packed or transported, just as a batch of nestly stacked paper cups maintains the shapes of the cups.

To use a container, one simply takes one container out of a stack and stands it upon a surface by its wide base. For example, during a flu or allergy season, one may use this disposable container as a disposable trash receptacle by his pillow side on his bed or by his bedside; one can then dispose of waste objects or refuse into this non-tipping supported receptacle within reach at night while resting with much less disturbance. A driver can place the container as waste receptacle and place it on the seat next his driving seat, and dispose refuse into it while driving. The container can be used at a restroom, at an examination room of a clinic and a lot of other places. A batch of containers can also be used at a meticulously prepared indoor or outdoor party where everyone will get a receptacle to keep their used paper napkins, chicken bones, or other unpleasant waste out of sight and they can be decorated in a matching theme as other disposable items for the occasions.

Figure 10:
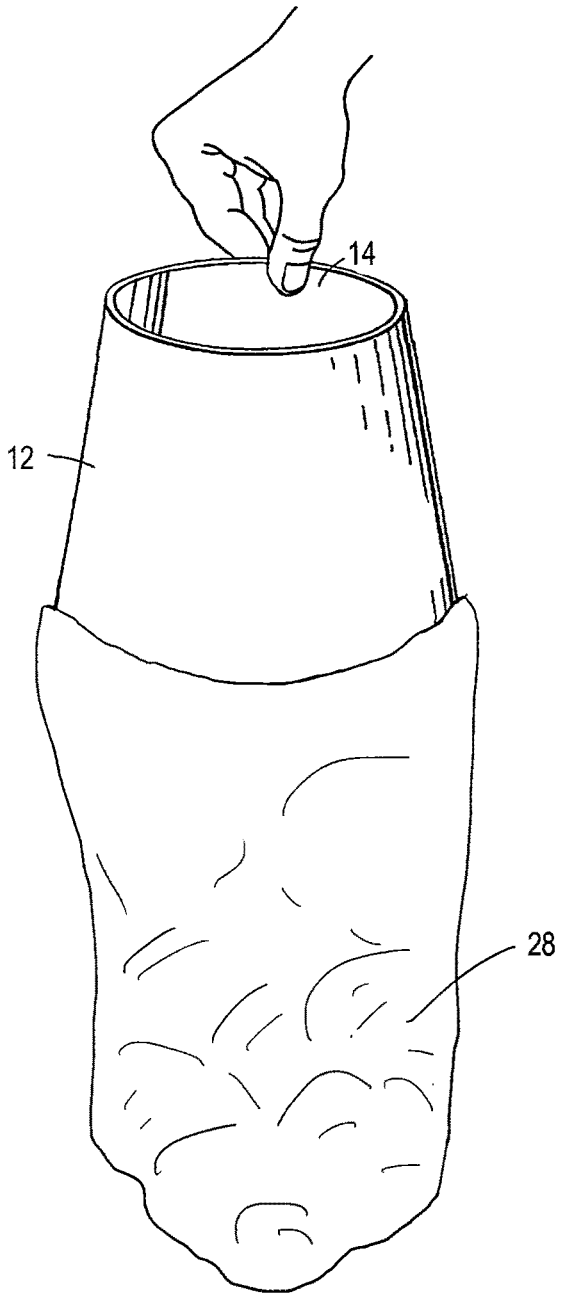
FIG. 10 is a perspective view of a container of FIG. 2 after the container in state of FIG. 8 having been lifted up by its upper rim.
Figure 11:
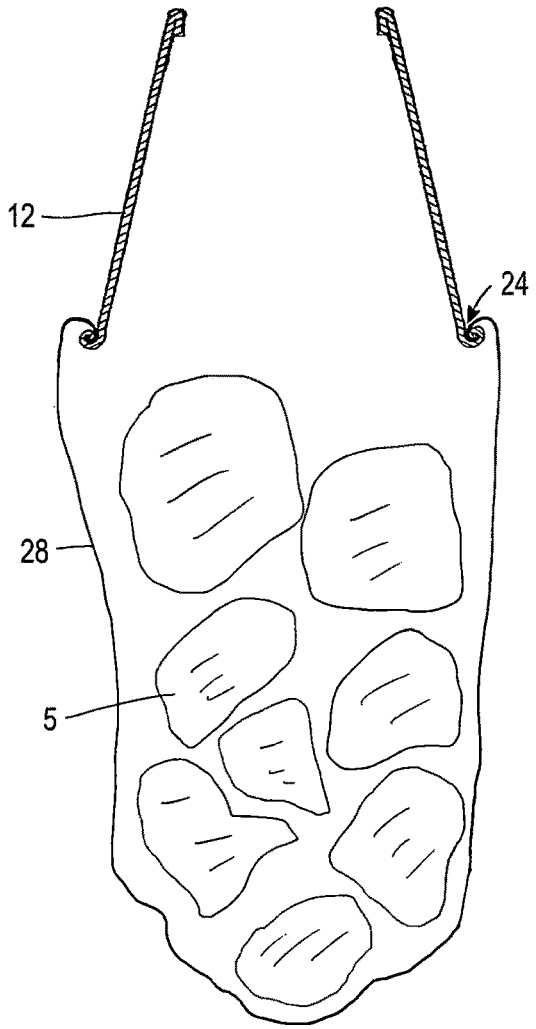
FIG. 11 is a cross-sectional view on line 3-3 of FIG. 10.
Figure 12:
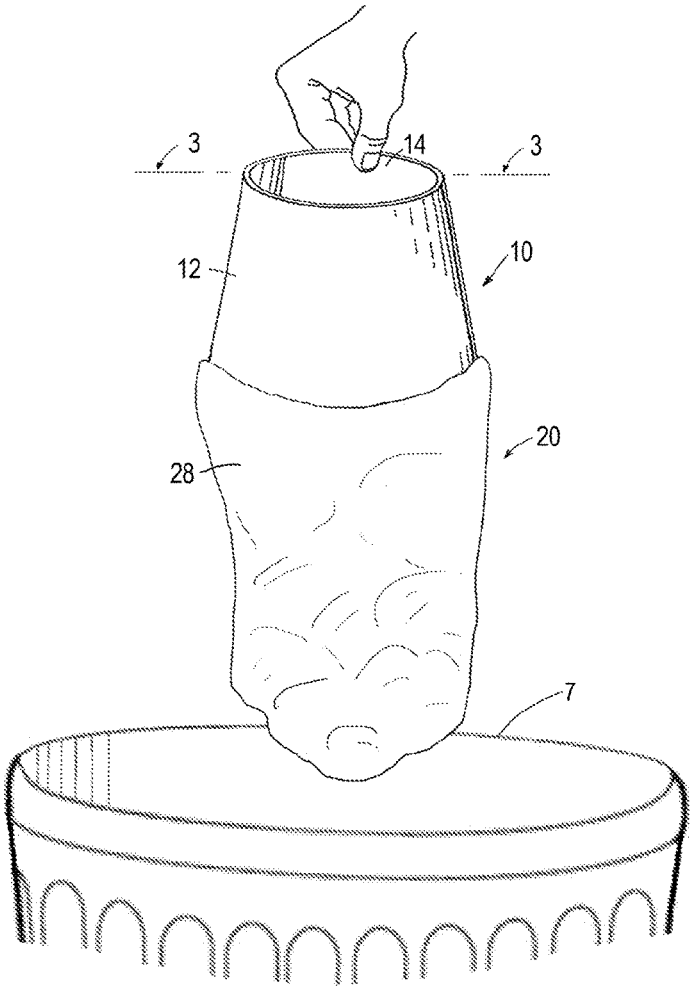

Once an object is disposed into a container in the state of FIG. 4, plastic film 28 inside will fall to the base and will release space for holding objects, as is shown in FIG. 8 and FIG. 9. When the container is about to be filled up, one can dispose the container into a larger trash can as shown in FIG. 12, or one can just lift up paper part 10 by its rim 14 and one can allow plastic bag 20 at the base to extend outwardly and downwardly. Thus the objects inside will drop down into plastic bag 20, releasing again the space inside paper part 10, as is shown in FIG. 10 and in FIG. 11. A container in the state of FIG. 10 also has the side benefit of reminding the user that the container is about to be filled up. FIG. 13 and FIG. 14 show the container in the state of FIG. 11 standing with its lower plastic bag portion bulged out, and having adequate space for receiving more disposable items.

Figure 15:
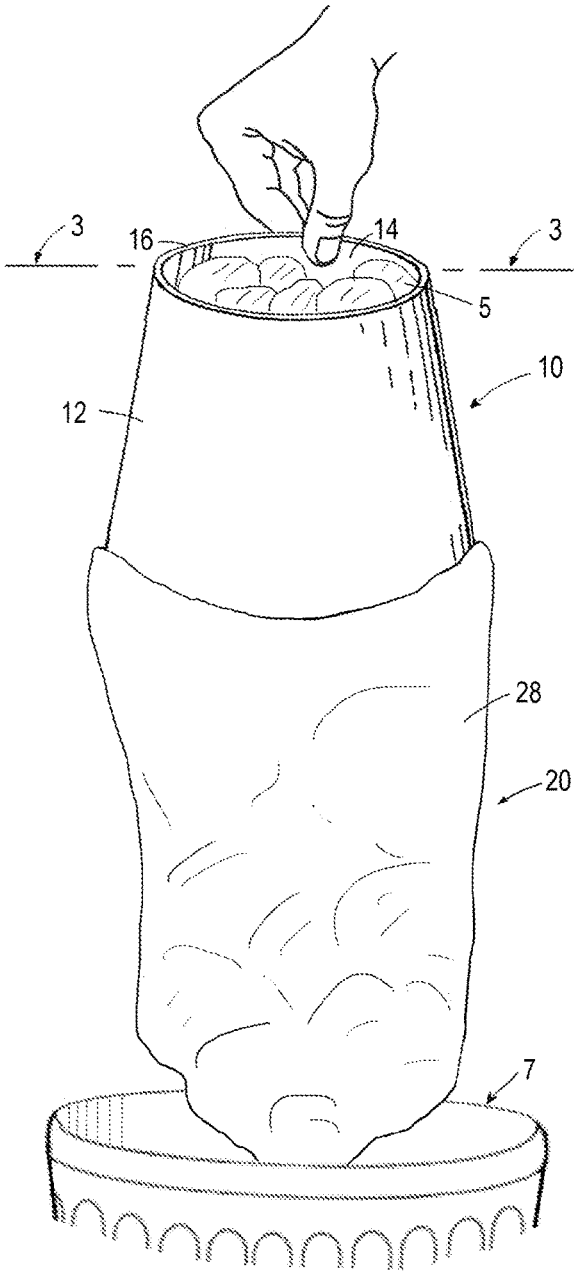
FIG. 15 is a perspective view of a container of FIG. 2 filled with disposable items, the container being lifted up by its upper rim.
Figure 16:
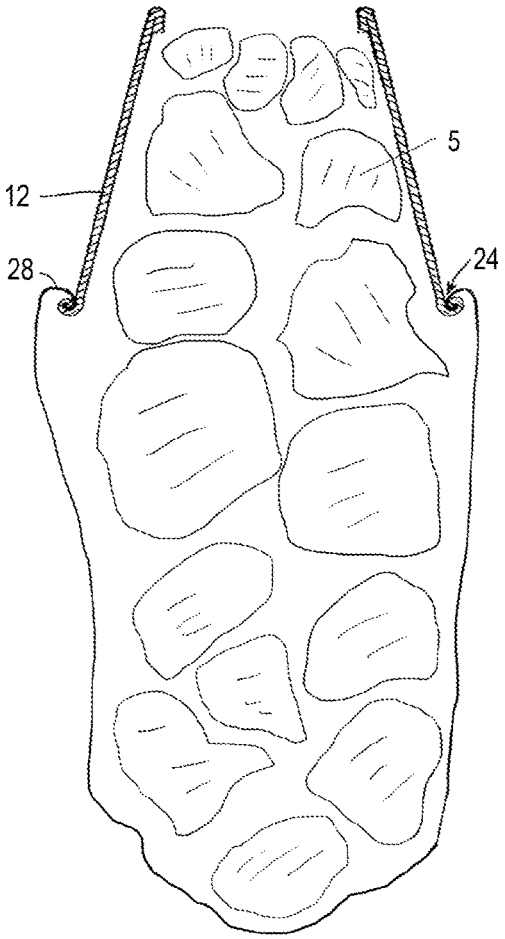
FIG. 16 is a cross-sectional view on line 3-3 of FIG. 15.

When the container is filled up, one can just dispose of the whole container in a large garbage can, as shown in FIG. 15. FIG. 15 is a perspective view of a container of FIG. 2 filled with disposable items 5, also sometimes called refuse, and the container is lifted up by its upper rim 14. FIG. 16 is a cross-sectional view on line 3-3 of FIG. 15 showing disposable items 5 inside the container.

The container can be used not only as a waste receptacle, but also a storage container for items to keep.

ALTERNATIVE EMBODIMENTS

The container is mostly about having a space-saving, collapsible and flexible bag with a supported non-tipping non-collapsible opening. The article can be made with any of a variety of kinds of materials and shapes. In the above example, the non-collapsible opening is the paper frustoconical tube connected with a collapsible flexible plastic bag.

The rigid flared portion of the container could be of various shapes and size: the outward shape could be like that of a paper cup or it could be like a rigid flared ring. It could be as big as or bigger than a regular sized bucket or as small as or smaller than a small size disposable cup.

Figure 29:
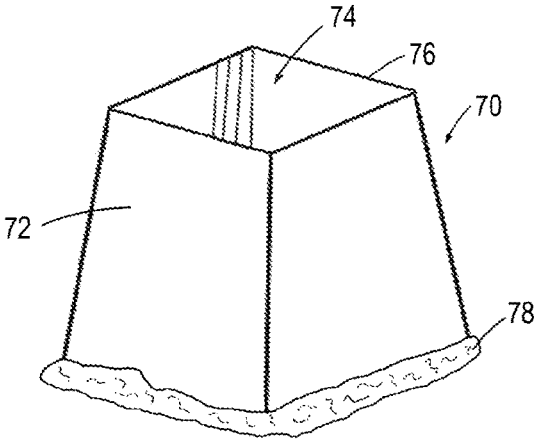
FIG. 29 is a perspective view of a container in the shape of a frustum of a square pyramid.

The flared rigid portion of the container can be of various base shapes and material. FIG. 29 is a perspective view of a disposable container in the shape of a frustum of a pyramid 70 instead of a frustoconical shape in the example discussed above. The rigid portion of the container can also be of a shape of a frustrum of an oval base cone or of any other base shapes. The material of the rigid portion could be of paper, metal, plastic coated paper, paper conditioned with other appropriated material, foam, plastic, non-collapsing mesh material or and any other rigid non-collapsing material.

The flexible portion of the container could be of various shapes and of material of plastic, cloth, flexible mesh material or of any other soft flexible material depending on the purpose of usage of the container.

The continuous connection of the rigid portion to the flexible portion could be formed by curling tightly the bottom opening rim along with the mouth region of flexible portion. Another possible connection approach is by means of ultrasonic welding of plastic to plastic or heat welding of plastic to plastic. Still another possible approach is that the mouth of the plastic bag is glued or stitched to the rim of the rigid portion. Connection can also be formed by any other means.

FIG. 18-23 and FIG. 30 have shown that there are various accessories that can be attached to the container.

Figure 17:
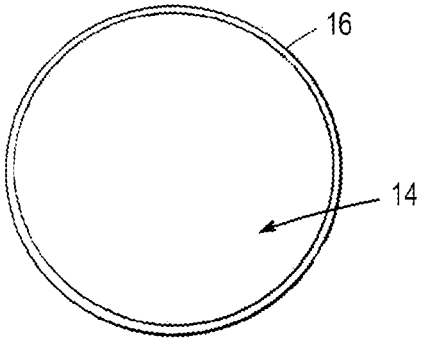
FIG. 17 is a sectional top view of the top opening of a container of FIG. 2 formed only by the top edge rim of the paper wall.
Figure 18:
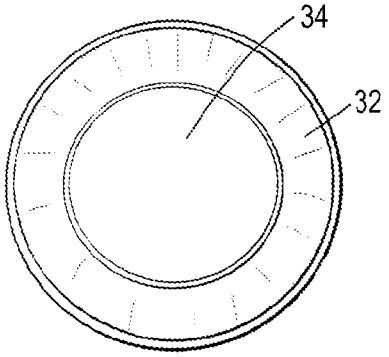
FIG. 18 is a sectional top view of the top opening of a container containing an upper end wall with a sizable hole in the middle for object disposition.
Figure 19:
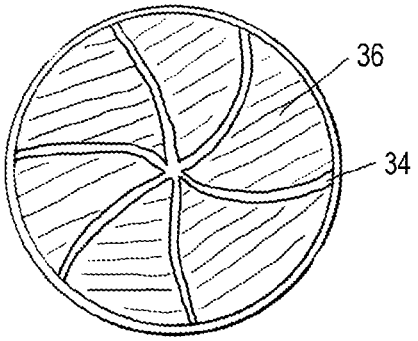
FIG. 19 is a sectional top view of the top opening of a container with an opening that is partially covered by a set of flexible flaps.

FIG. 17 shows a sectional top view of the top opening of the disposable container formed only by the top edge rim of the paper wall as is shown in the above example. FIG. 18 is a sectional top view of the top opening of disposable container containing a top end wall with a hole 34 in the middle for object disposition. FIG. 19 is a sectional top view of the top opening of disposable container illustrating that the opening is partially covered by a set of flexible flaps 36.

Figure 20:
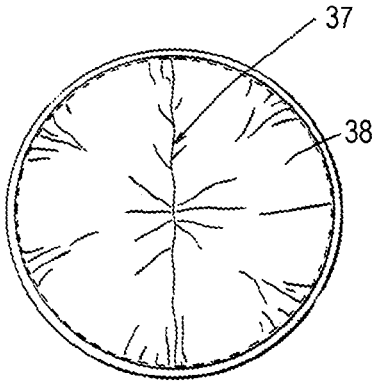
FIG. 20 is a sectional top view of the top opening of a container with an opening that is covered by a flexible sheet with a cleave line across it for disposing of objects.
Figure 21:
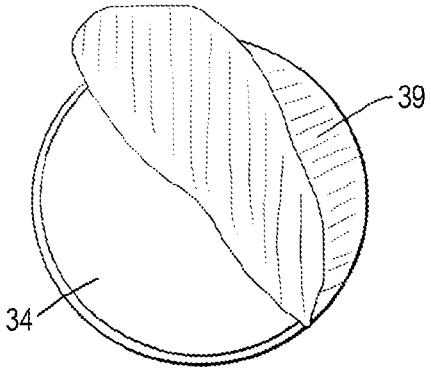
FIG. 21 is a sectional top view of the top opening of a container with an opening covered by a tab that is ready to be peeled.

FIG. 20 is a sectional top view of the top opening of disposable container illustrating that the opening is covered by a flexible sheet with a cleave line 37 across it for disposing objects. FIG. 21 is a sectional top view of the top opening of disposable container illustrating that the top opening is covered by a tab 39 that is ready to be peeled off.

Figure 22:
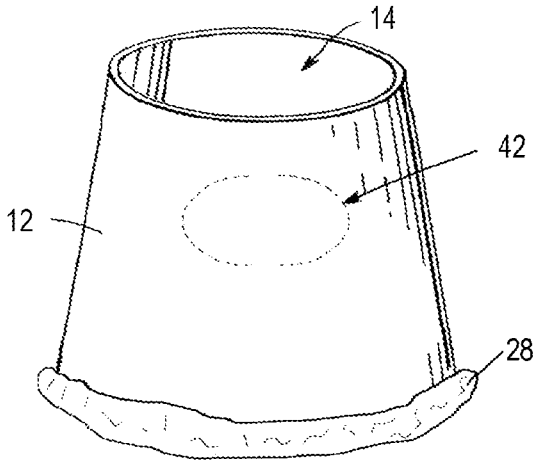
FIG. 22 is a perspective view of a container containing perforation curve lines serving as potential handles.
Figure 23:
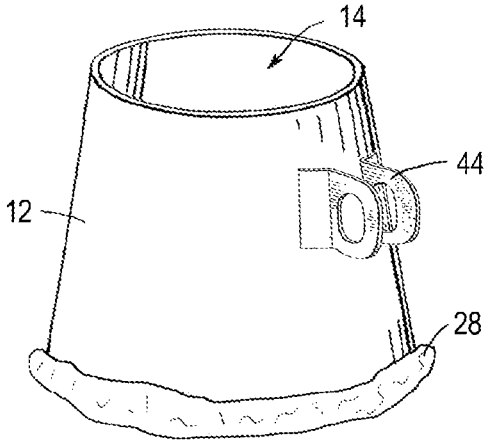
FIG. 23 is a perspective view of a container with a pair of paper handles.

FIG. 22 and FIG. 23 show that the disposable container can also have handles for facilitating usage and disposition: FIG. 22 is a perspective view of a disposable container with perforation curves 42 for serving as potential handles and FIG. 23 is a perspective view of a nestable and stackable wide-base disposable container attached by a pair of paper handles 44.

Figure 30:
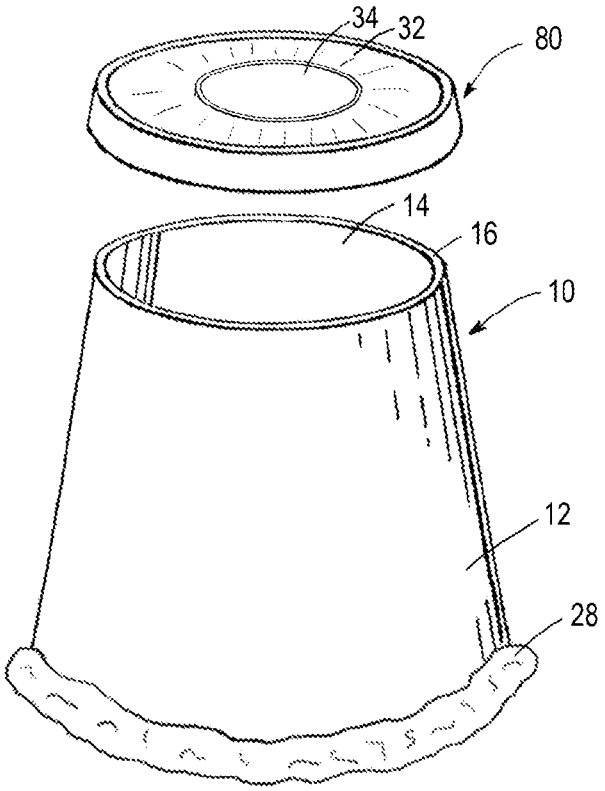
FIG. 30 is an exploded view of a container and a cover for the container.

FIG. 30 is an exploded view of a container and a cover 80 for the container. The cover 80 has an opening 34 through which refuse may be deposited.

FIG. 24-28 have shown some accessories that can be attached to the container for fastening it in place when used in an environment that is often moving and changing, such as in a moving vehicle or if the user chose to hang the container instead of standing it on a surface.

Figure 24:
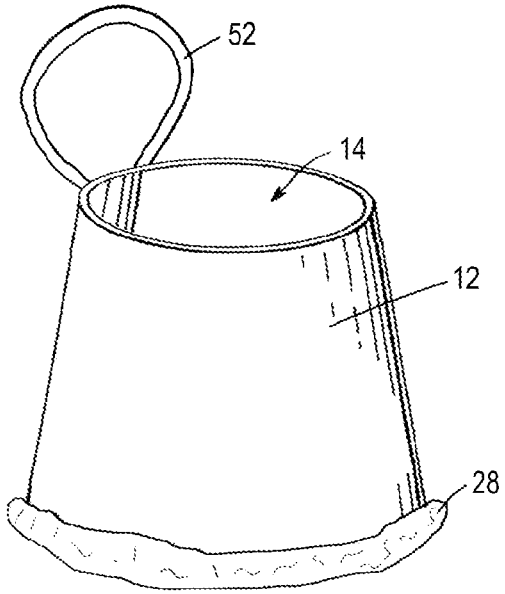
FIG. 24 is a perspective view of a container having a loop grip.

FIG. 24 is a perspective view of a container having a loop grip 52.

Figure 25:
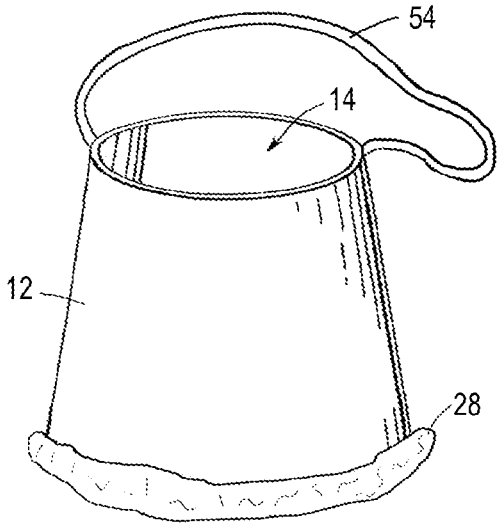
FIG. 25 is a perspective view of a container having a strap.

FIG. 25 is a perspective view of a container having a strap 54.

Figure 26:
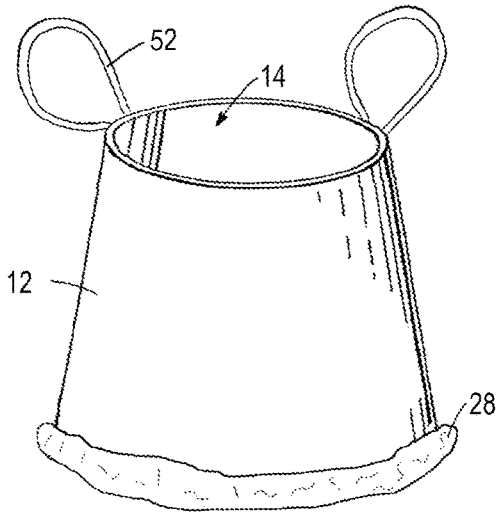
FIG. 26 is a perspective view of a container having two loop grips.

FIG. 26 is a perspective view of a container having two loop grips 52.

Figure 27:
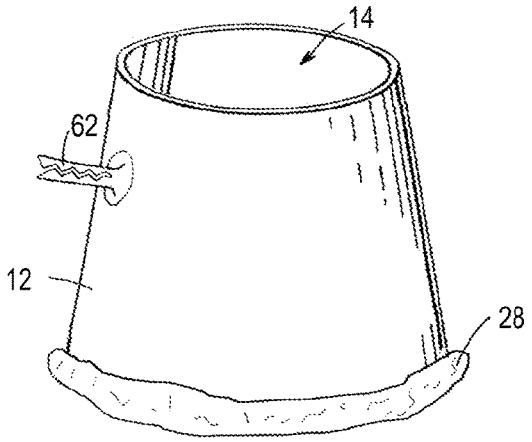
FIG. 27 is a perspective view of a container having a pin.

FIG. 27 is a perspective view of a container having a pin 62.

Figure 28:
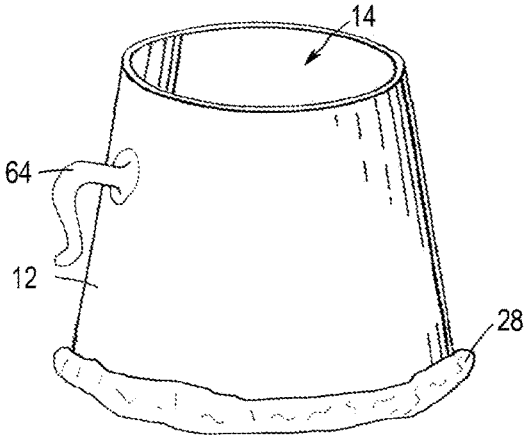
FIG. 28 is a perspective view of a container having a handle.

FIG. 28 is a perspective view of a container having a handle 64.

While the container has been described with reference to an exemplary embodiment, it will be understood by the alert reader that various changes, omissions and/or additions may be made and equivalents may be substituted for elements thereof without departing from the spirit and scope of the invention. In addition, many modifications may be made to adapt a particular situation or material to the teachings of the invention without departing from the scope thereof. Therefore, it is intended that the invention not be limited to the particular embodiment disclosed as the best mode contemplated for carrying out this invention.

REFERENCE NUMERALS

5—items for disposition (not part of the invention)
7—trash can (not part of the invention)
10—paper frustoconical tube
12—paper side wall
14—hollow inside of paper tube
16—upper edge rim
18—lower edge rim
20—plastic bag
22—opening of plastic bag 20
24—connection of paper tube 10 and plastic bag 20
26—hollow inside of plastic bag 20
28—plastic film of plastic bag 20
32—upper end cover with sizable hole in the middle
34—opening in the middle of cover 32
36—flap
37—cleave line
38—sheet
39—tab
42—perforation line on the paper side wall 12
44—paper handles
52—loop grip
54—strap
62—clip
64—handle
70—disposable container in a shape of a frustrum of a pyramid
72—paper side wall of container 70
74—hollow inside of paper side wall 72
76—upper rim of paper side wall 72
78—plastic bag part of container 70
80—cover of container

I claim:

1. A method of storing and using disposable containers, comprising:

providing a set of disposable containers, said set comprising more than one substantially identical container, each container comprising an outwardly and downwardly flared hollow receptacle with a capacity for receiving waste having:

a bottom with a bottom opening therein, a top with a top opening therein, said top opening configured to permit the passage of waste, said top opening being smaller than said bottom opening, sidewalls between said bottom and said top, said sidewall having an interior surface and an exterior surface, said receptacle defining a substantial capacity for receiving waste; and a flexible bag mounted at the edges of said bottom of said receptacle, said bag having a bag opening therein, said bag opening being fixedly and continuously attached to the bottom edges of said sidewalls, enabling said bag to receive and retain all waste that passes through said receptacle via said top opening, said flexible bag defining a capacity that is at least the capacity of said receptacle;

providing a set of said containers, having each container with its bag pushed inside towards said interior surface of said sidewalls;

nesting and stacking said containers to form a stack of containers;

removing one said container from said stack;

standing said container on its bottom;

placing waste into said container via said top opening of said container;

discarding said container as a whole unit when filled;

whereby said set of said containers can be stacked and nested into a stack of compactly nested containers, each said container can stand non- tipping on said bottom, receives waste from said top opening, and be discarded as a whole unit hassle-free when filled.

2. The method of claim 1 further comprising the step, performed before the discarding step, of extending said flexible bag outwards from said receptacle, whereby said receptacle and said bag together at least double the capacity of said receptacle alone.

* * * * *